United States Patent [19]

Allgaier et al.

[11] Patent Number: 5,018,684

[45] Date of Patent: May 28, 1991

[54] OPTICAL GUIDE BEAM STEERING FOR PROJECTILES

[75] Inventors: Karl-Heinz Allgaier, Ottobrunn; Christian Diehl; Horst Kirsche, both of Munich, all of Fed. Rep. of Germany

[73] Assignee: Messerschmitt-Bölkow-Blohm GmbH, Munich, Fed. Rep. of Germany

[21] Appl. No.: 732,186

[22] Filed: Feb. 27, 1985

[30] Foreign Application Priority Data

Feb. 29, 1984 [DE] Fed. Rep. of Germany ..... 3407398

[51] Int. Cl.[5] ..... F41G 7/24

[52] U.S. Cl. ..... 244/3.13

[58] Field of Search ..... 244/3.13

[56] References Cited

U.S. PATENT DOCUMENTS

| | | | |
|---|---|---|---|
| 4,020,339 | 4/1977 | Gustafson | 244/3.13 |
| 4,030,686 | 6/1977 | Buchman | 244/3.13 |
| 4,318,591 | 3/1982 | Elterman | 244/3.13 |

FOREIGN PATENT DOCUMENTS

| | | |
|---|---|---|
| 2550767 | 7/1976 | Fed. Rep. of Germany . |
| 2658689 | 7/1977 | Fed. Rep. of Germany . |
| 3105219 | 9/1982 | Fed. Rep. of Germany . |
| 2093309 | 10/1984 | United Kingdom . |

*Primary Examiner*—Charles T. Jordan

*Attorney, Agent, or Firm*—Toren, McGeady & Associates

[57] ABSTRACT

In an optical beam riding guidance for missiles according to the beam rider method, a definite recognition of the roll attitude and the location assignment is carried out in dependence on the expiring time in a simple manner and without previous synchronization with the launching installation.

3 Claims, 1 Drawing Sheet

OPTICAL GUIDE BEAM STEERING FOR PROJECTILES

BACKGROUND OF THE INVENTION

Optical beam riding guidance for missiles which are guided from launching to the target along a line of sight of a sighting device, wherein the launching device comprises at least one light source whose sharply focused light beam is deflected with reference to the line of sight so that the light beam impinges on a receiver at the missile and a location assignment and tracking of the missile on a line of sight is performed in an evaluating circuit, wherein either the reference of the location assignment to the expiring time is produced by means of a time base which follows in the evaluating circuit and is synchronized with the launching device until the moment of launching, or a time base can be triggered by means of using a second pulse-modulated reference light source arranged parallel to the line of sight.

Optical guide beam systems, in which modulated light waves are used for guiding a missile, are known from various publications.

DE-AS 16 23 391 describes a system for the optical beam riding guidance of vehicles, in which a guide beam runs over a fixed angle of space in a periodically alternating direction. In addition, a reference signal transmitter is provided which marks a determined position of the guide beam at determined points in time. In order to produce the modulated and deflected guide beams in the launching installation and for the reception and evaluation in the missile this system requires considerable expenditure in terms of circuit technology if a great accuracy of the tracking is to be achieved. Moreover, an evaluation of the roll attitude of the missile is not possible.

A device for guiding a missile by means of a light beam which is deflected in a spiraling manner is known from DE-OS 26 58 689. This guiding device enables the detection of the roll attitude of the missile, however it requires a synchronization of the time clock in the missile with the time clock of the deflecting device in the launching installation. In addition, a high-precision timing pulse generator synchronized before the launch is required in the evaluating circuit of the missile, which timing pulse generator could previously only be used in missiles with relatively low starting accelerations, since the high initial accelerations of approximately 50,000 g occurring, for example, in shells lead to a compulsory outage of the time clock.

SUMMARY OF THE INVENTION

The invention has the object of providing a signal evaluation, according to the type named in the preamble, for a high-acceleration missile which, from the time the missile is launched, evaluates the optical signals of the beam rider guidance system present in the launching installation and analyses the roll attitude of the missile as well as the time reference for the location assignment in space by means of the optical signals without needing a timing synchronization before the launch and without the need to use any position or time measuring devices, such as gyroscopes or crystals, which are sensitive to acceleration.

The drawing shows an embodiment example of the invention which is described in more detail in the following.

DETAILED DESCRIPTION OF THE INVENTION

Figure 1:
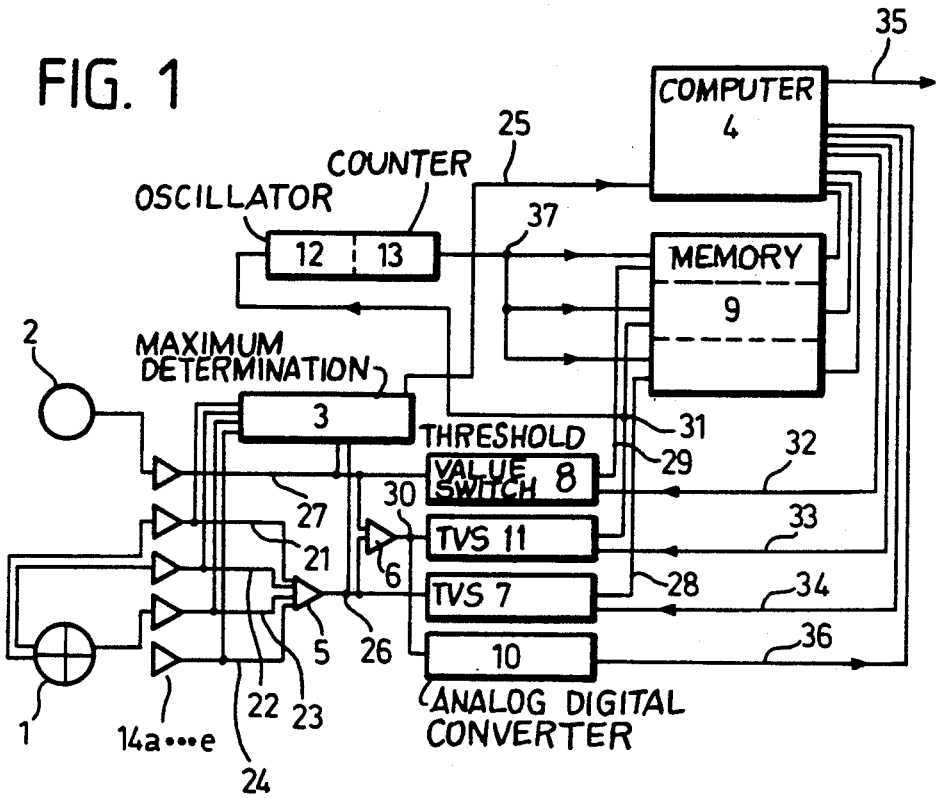
FIG. 1 shows a block diagram of an optical beam riding guidance for missiles.

FIG. 1 shows the components of the signal evaluation of an optical beam riding guidance for missiles according to the invention. The two light-sensitive detectors 1, 2 are arranged relative to one another in such a way that each one receives for itself the polarized light signals of one of the two polarization planes which are perpendicular to one another. The light signals originate from two lasers used as light sources which are attached in the launching installation so as to be parallel to the launching direction. One of the two lasers produces a roll reference signal by means of a cyclical spiral deflection of the light beam around the sighting axis. The other transmits a time reference signal and possibly also additional data to be transmitted to the missile.

In the example described here only the first detector 1 is constructed as a four-quadrant detector, the second detector 2 is needed as a simple detector for the signal evaluation according to the invention; but it can be provided as a four-quadrant detector if necessary. The output signals are amplified in a known manner 14*a*, . . . , *e*.

The output signals 21, 22, 23, 24 are added in the mixer amplifier 5. The sum 26 represents the roll signal received by the four-quadrant detector 1, which roll signal is guided to the memory 9 of the computer 4 as signal 28 via the adaptive threshold value switch 7. The output signal 27 of the second detector 2 is likewise supplied to the memory 9 as signal 29 as a roll signal offset by 90° via the adaptive threshold value switch 8 which has the same switching threshold as the threshold value switch 7.

The time reference signal 30 is obtained by means of adding the two roll signals 26 and 27 in the mixer amplifier 6 and is fed to the memory 9 as a time signal 31 via the adaptive threshold value switch 11. At the same time, the time reference signal 30 is guided via the analog/digital converter 10 and then serves the computer 4 as information 36 on the respective available signal amplitude of 30. The time signal 31 triggers the free-running oscillator 12 of the counter 13, whose counter state 37 is likewise processed in the memory 9. The oscillator 12 is constructed here, for example, as a simple free-running and shock-resistant RC oscillator whose accuracy is sufficiently great to ensure a favorable tracking by means of the computer 4, even during a brief outage of the synchronization by means of the time signal 31.

The maximum determination unit 3 evaluates the output signals 21, 22, 23, 24 of the four-quadrant detector 1 and uses the roll signals 26 and 27 as reference values. The output signal 25 transmits the definite roll attitude of the missile to the computer 4 which calculates the necessary course corrections by means of all the available data and relays them to the control members of the missile via the line 35. The adaptive threshold value switches are also controlled from the computer 4 via the lines 32, 33, 34.

Figure 2:
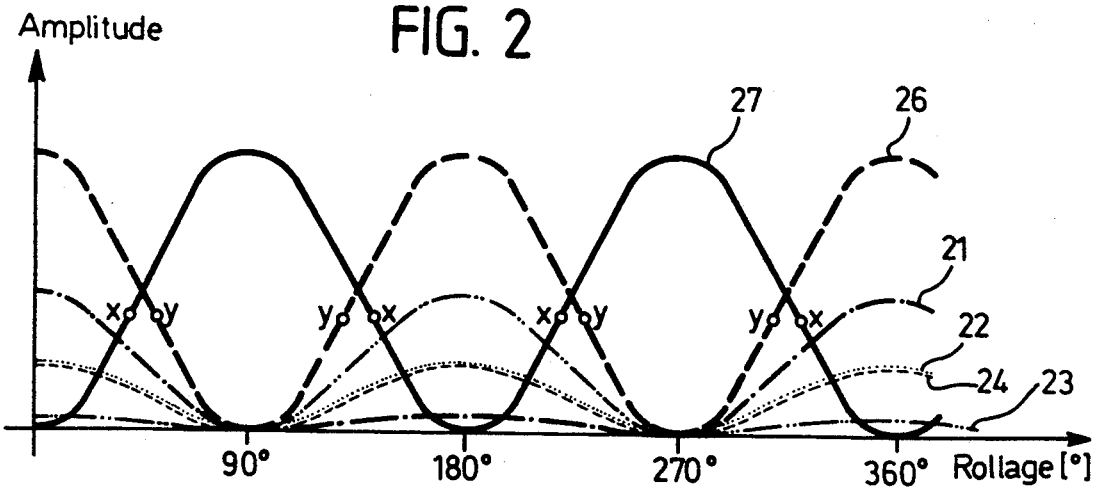
FIG. 2 shows a graph of the detector signals in dependence on the roll attitude of the missile.

FIG. 2 shows the amplitude curve (over the roll attitude) of the detector signals 21, 22, 23, 24 and 27, as well as the roll signal 26 which represents the sum of the output signals 21, 22, 23, 24 of the four-quadrant detector 1. The signal 21 represents here, by way of example, the output signal of that quadrant which receives the signal with the greatest amplitude as determined by polarization. The points X, Y on the signal curves 26, 27 correspond to possible switching thresholds of the adaptive threshold value switches 7 and 8. The ratio of the two detector signals 26 and 27 is a measurement for the roll attitude. This can be determined most accurately if the ratio is equal to one, i.e. in FIG. 2 at the points $45°+n.90°$ ($n=0, 1, 2 \ldots$). The intermediate values can then be determined mathematically assuming the roll frequency of the missile does not change substantially during a quarter turn. Accordingly, all intermediate values of the location assignment can be determined by means of the synchronized oscillator and counter 12, 13. Accordingly, it it also possible to continue flying on the previously calculated actual path during a brief signal outage.

The special advantage of the signal processing, according to the invention, consists in the elimination of the elliptical distortions which always occur when the missile flys diagonally in the guide beam. Disturbances of the signal transmission caused by atmospheric conditions are also eliminated by means of the relationship formation of the signals of the two detectors.

The actual roll attitude can be definitely determined in that the output signals 21, 22, 23, 24 of the four-quadrant detector 1 are also fed to the maximum determination 3 which determines, with reference to the two roll attitude signals 26, 27, when a respective quadrant has the maximum amplitude. Since the launching axis of the missile lies at a determined distance parallel to the illumination axis, the laser beams produce an asymmetrical illumination of the four-quadrant detector. That is, it can be definitely determined by means of this type of signal evaluation whether the missile is located, according to FIG. 2, in the intersecting point of the signal curves 26 and 27 in the 45° roll attitude or in the 225° roll attitude.

The signal processing circuit according to FIG. 1 is distinguished through the use of a simple oscillator 12 which, together with the counter 13, forms the time base of the missile. The signals transmitted from the launching installation are received by the detectors, filtered, if necessary, and guided via adaptive thresholds. The latter controls a decoding mechanism provided in the memory 9 by means of which the respective counter states 37 of the time base 12, 13 are secured in the memory 9. The differences of the stored counter states are a proportion for the time differences which are transmitted directly from the computer 4 into the values for the deflection for the guide beam axis, the roll attitude and possibly the information for a data bus.

We claim:

1. Optical beam riding guidance for a missile which is guided from the launching to the target along a line of sight of a sighting device, wherein a launching device comprises one first light source whose sharply focused light beam is deflected with reference to said line of sight so that said light beam impinges on a receiver at said missile and a location assignment and tracking of said missile on a line of sight is carried out in an evaluating circuit, wherein one of said location assignment to an expiring time is produced by means of a time base which follows in said evaluating circuit and is synchronized with said launching device until the moment of launching, and a time base can be triggered by means of using a pulse-modulated reference second light source arranged parallel to said line of sight, characterized through the following characteristic features:

polarized light signals, which are generated by said first light source comprising a deflected coherent roll reference light source and said second light source comprising a pulse-modulated coherent time reference light source which are mounted in a launching installation with parallel light beam axes, are received by a first detector (1) and a second detector (2) with polarization filters which are perpendicular with respect to one another, at least one of which is constructed as a first detector with a plurality of sectors (1);

the output signals (21, 22, 23, 24) of said first detector with a plurality of said sectors (1) are fed on the one hand to a maximum determination unit (3) whose output signal (25) is fed to a computer (4) as an input value;

said output signals (21, 22, 23, 24) of said first detector with a plurality of said sectors (1) are combined, on the other hand, in a first mixer amplifier (5) whose output signal (26) is supplied to a first threshold value switch (7), as well as to a second mixer amplifier (6) to which an output signal (27) of said second detector (2) is fed in turn as a second input value, and said output signal (27) of said second detector is simultaneously also fed to a second threshold value switch (8) as an input signal;

output signals (28, 29) of said first and second threshold value switches (7, 8) are read into a memory (9) of said computer (4);

an output signal (30) of said second mixer amplifier (6) is fed to said computer (4) as a time reference signal firstly via an analog-digital converter (10) and secondly via a third threshold value switch (11) as a time signal (31) to said memory (9) of said computer (4), as well as to an oscillator (12) of a counter (13) as a trigger signal, the counter state (37) of said counter (13) being fed to said memory (9).

2. Optical beam riding guidance for missiles according to claim 1, characterized in that said output signal(26) of said first mixer amplifier (5) and said output signal (27) of said second detector (2) is supplied to said maximum determination unit (3) as reference values.

3. Optical beam riding guidance for missiles according to claim 1, characterized in that the switching thresholds of said threshold value switches (7, 8, 11) are adaptively (32, 33, 34) controllable by said computer (4).

* * * * *